US006308840B1

(12) United States Patent
Mulholland et al.

(10) Patent No.: US 6,308,840 B1
(45) Date of Patent: Oct. 30, 2001

(54) GOLF CLUB AND UMBRELLA HOLDING DEVICE

(76) Inventors: Kevin Mulholland, 49 Willis Rd., North Arlington, NJ (US) 07031; Vincent Dattolo, 21C King St., Morristown, NJ (US) 07960

( * ) Notice: Subject to any disclaimer, the term of this patent is extended or adjusted under 35 U.S.C. 154(b) by 0 days.

(21) Appl. No.: 09/345,116

(22) Filed: Jul. 6, 1999

(51) Int. Cl.[7] ..... A63B 55/10; A45B 3/00
(52) U.S. Cl. ..... 211/70.2; 135/16; 206/315.2
(58) Field of Search ..... 211/70.2, 123, 211/124; 206/315.1, 315.2, 315.6; 135/15.1, 16

(56) References Cited

U.S. PATENT DOCUMENTS

| | | | | |
|---|---|---|---|---|
| 2,887,137 | | 5/1959 | Robb . | |
| 3,014,595 | | 12/1961 | Bartmann . | |
| 3,483,996 | * | 12/1969 | Scammon | 211/60 |
| 3,503,518 | * | 3/1970 | Black | 211/60 |
| 3,543,355 | * | 12/1970 | Wyckoff et al. | 24/81 |
| 3,870,300 | * | 3/1975 | Amendola | 273/32 B |
| 4,181,167 | * | 1/1980 | Ret | 150/1.5 R |
| 4,616,749 | * | 10/1986 | Briggs | 206/315.2 |
| 4,852,896 | | 8/1989 | Mills . | |
| 4,969,921 | * | 11/1990 | Silvera | 273/186 A |
| 5,238,109 | | 8/1993 | Smith | 206/315.2 |
| 5,332,090 | * | 7/1994 | Tucker | 206/315.3 |
| 5,366,075 | * | 11/1994 | Mills | 206/315.6 |
| 5,393,052 | * | 2/1995 | Kennedy | 273/32 B |
| 5,417,334 | | 5/1995 | Wu . | |
| 5,474,191 | | 12/1995 | Bergeron et al. . | |
| 5,636,734 | * | 6/1997 | Smith | 206/315.2 |
| 5,669,514 | | 9/1997 | Massetti . | |
| 5,673,718 | | 10/1997 | Kennedy et al. . | |
| 5,749,386 | | 5/1998 | Samuel, Jr. | 135/16 |
| 5,755,322 | * | 5/1998 | Yang | 206/315.2 |
| 5,820,479 | | 10/1998 | Cline et al. . | |
| 6,050,268 | * | 4/2000 | San Filippo | 131/257 |
| 6,059,300 | * | 5/2000 | Wu | 280/47.2 |

FOREIGN PATENT DOCUMENTS

| | | |
|---|---|---|
| 28 34 259 | 2/1980 | (DE) . |
| 960913 | 8/1997 | (IE) . |
| 06000106 | 1/1994 | (JP) . |
| 6-106 | 1/1994 | (JP) . |
| 07124010 | 5/1995 | (JP) . |
| 7-124010 | 5/1995 | (JP) . |
| 08336410 | 12/1996 | (JP) . |
| 8-336410 | 12/1996 | (JP) . |

* cited by examiner

*Primary Examiner*—Daniel P. Stodola
*Assistant Examiner*—Khoa Tran
(74) *Attorney, Agent, or Firm*—Carella Byrne Bain Gilfillan et al; John G. Gilfillan; William Squire

(57) ABSTRACT

A golf club holder suspends golf clubs beneath an umbrella to keep the grips dry during rain. The holder comprises a head with clip devices for attachment to an umbrella shank and for attaching the shafts of clubs upside down to the holder. The clip devices comprise in one embodiment a molded plastic head with receptacles for attachment to the umbrella shank and for receiving the club shafts, the receptacles each comprising a bore lined with high friction rubber and a slot for receiving the shank or shafts laterally into the receptacle. A stem extends from the head to provide enhanced gripping action to the umbrella shank. The devices may be hinged to the stem to permit the holder to remain with the umbrella shank so that the umbrella may be collapsed with the holder attached. The holder stem may be permanently attached to the umbrella shank with the shaft clip devices hinged to the stem.

13 Claims, 4 Drawing Sheets

FIG. 1
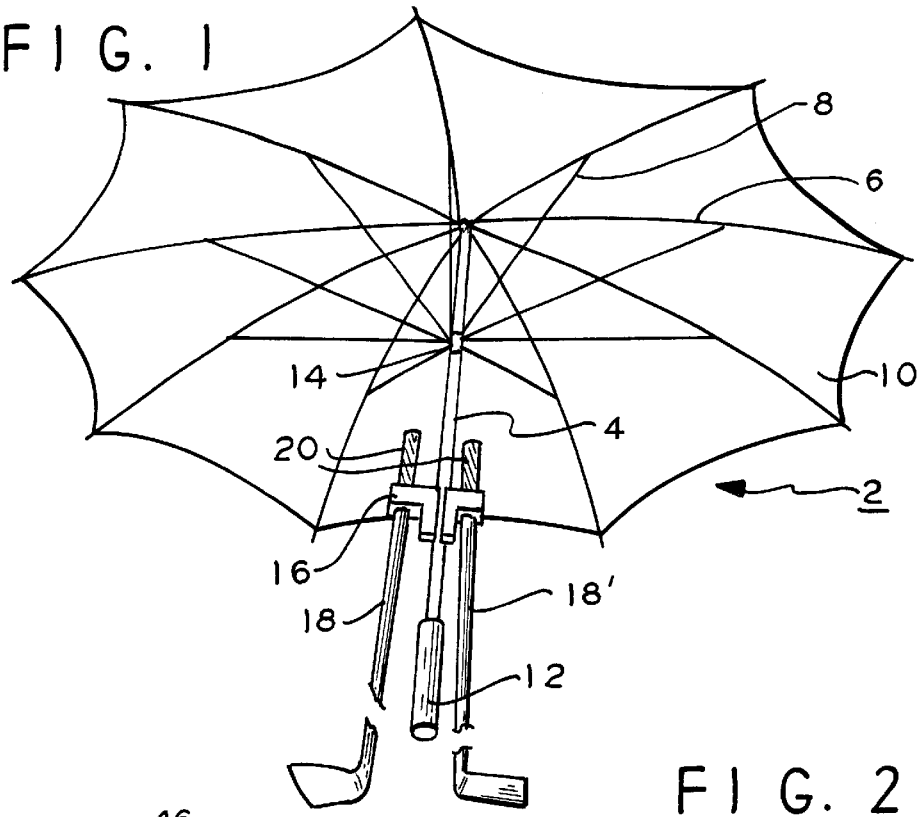
FIG. 2
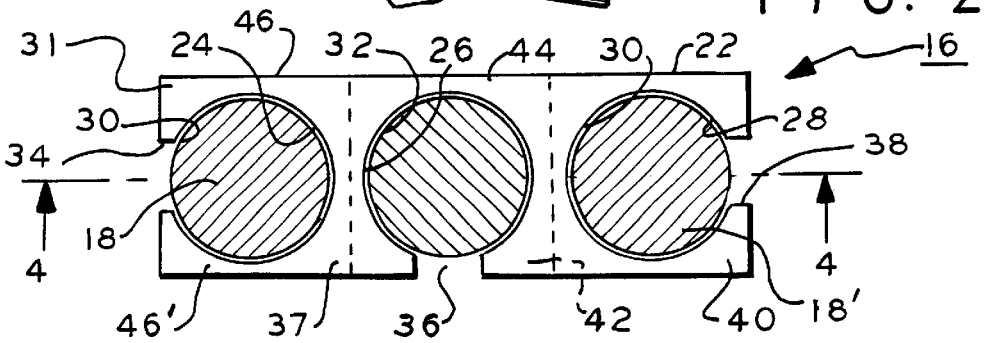
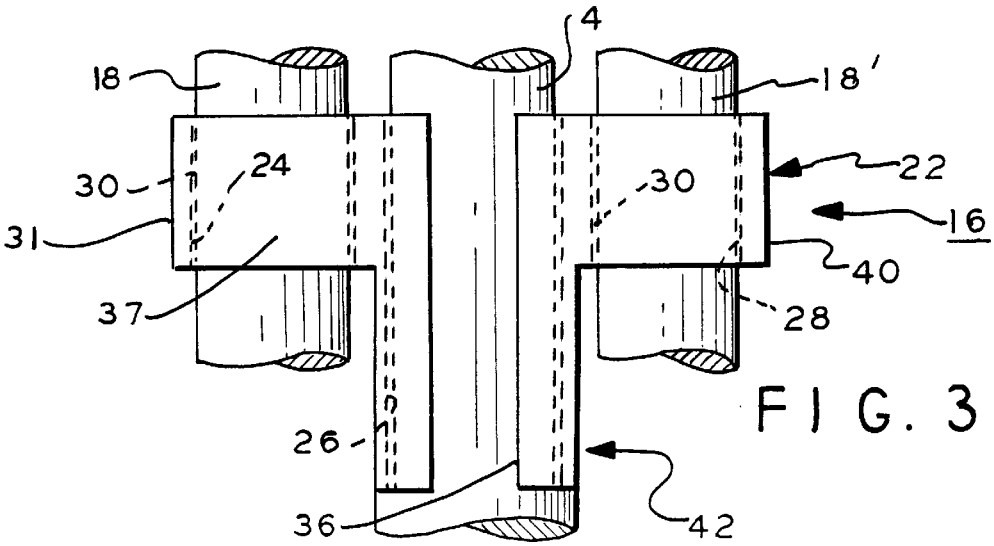
FIG. 3

FIG. 4
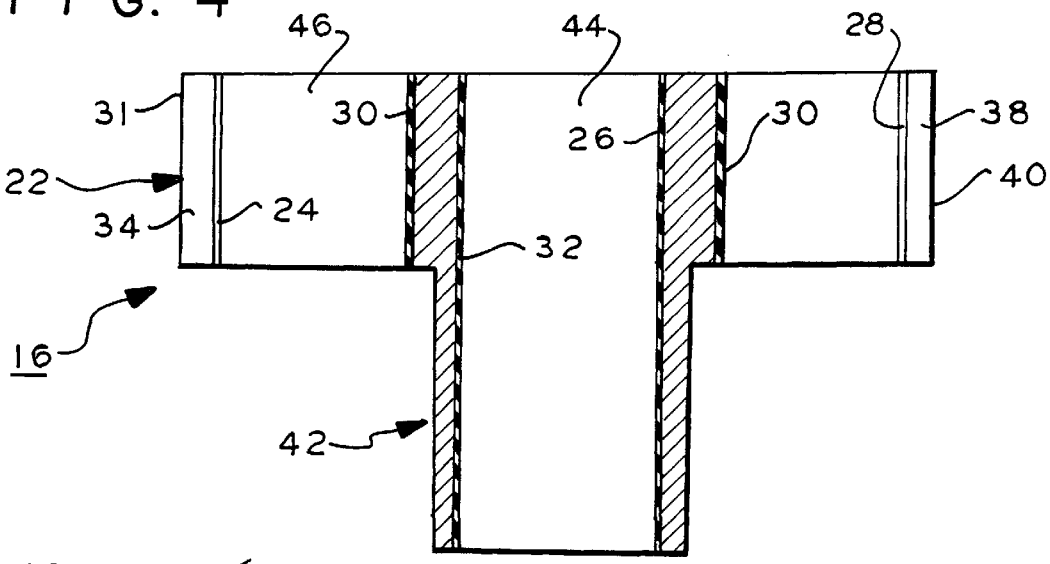
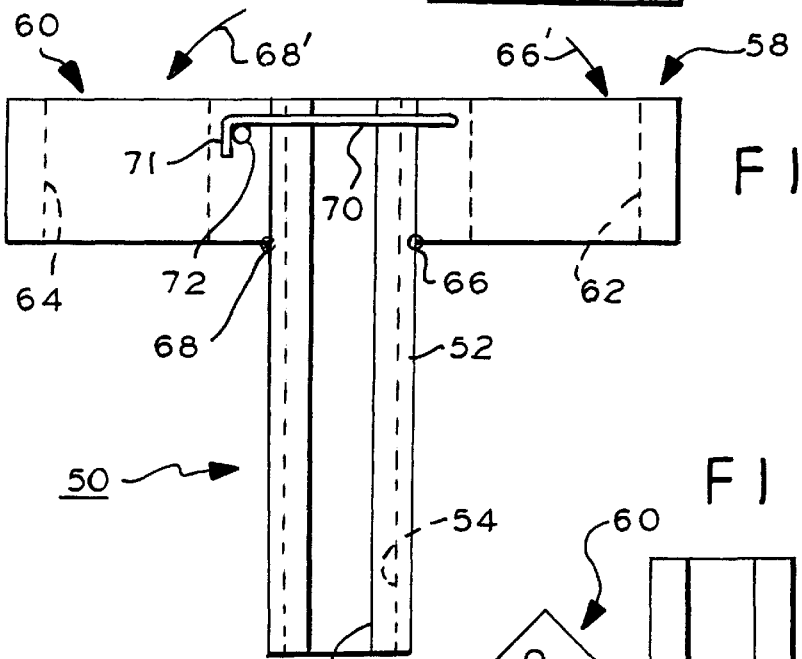
FIG. 5
FIG. 6
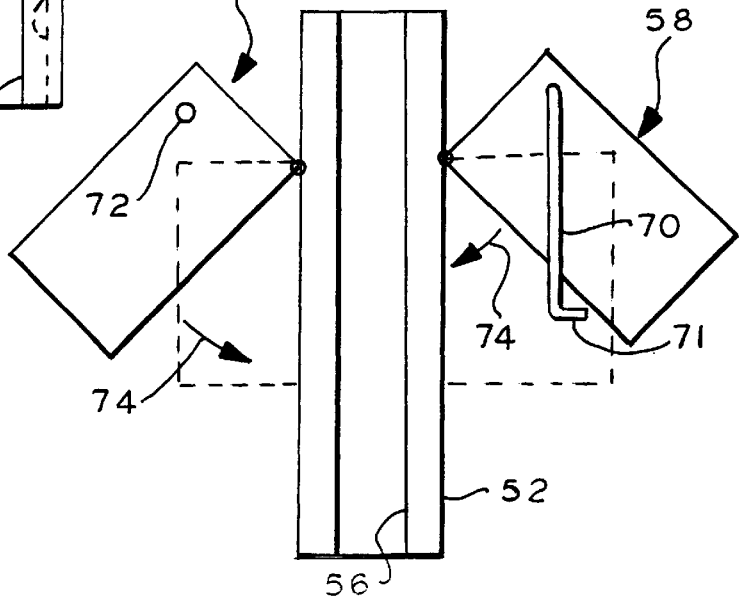

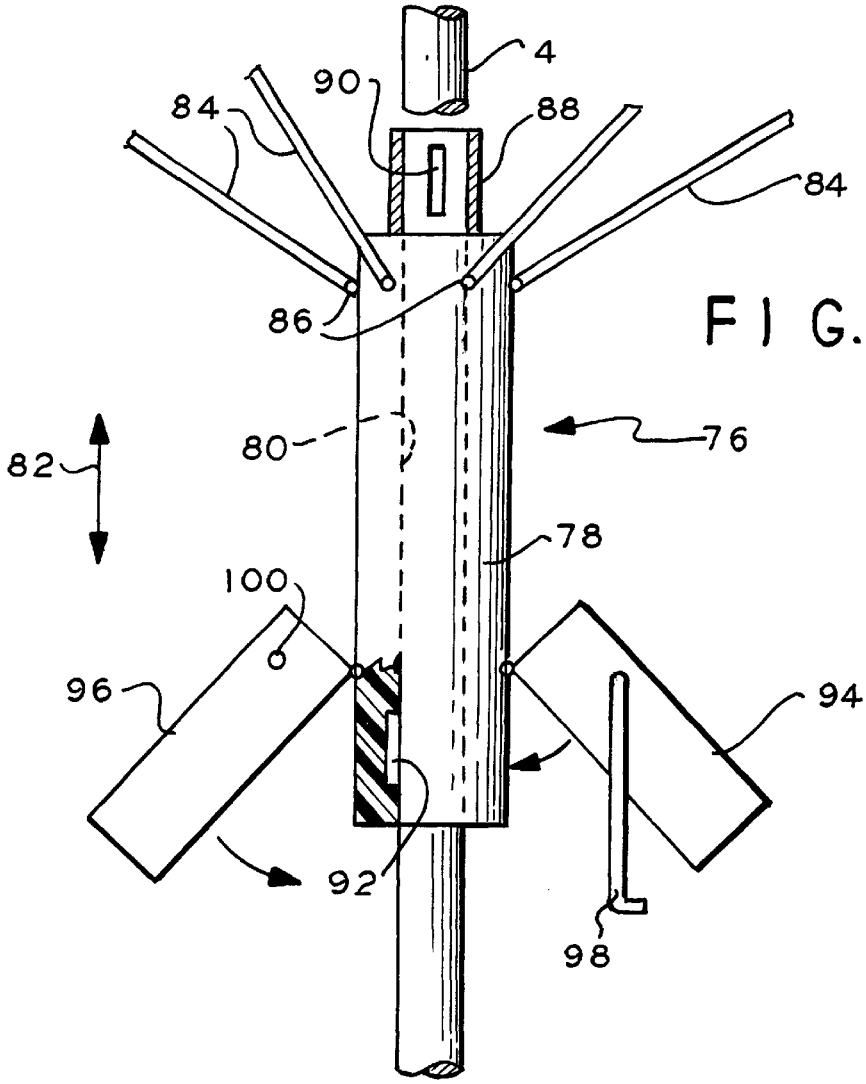
FIG. 7
FIG. 8
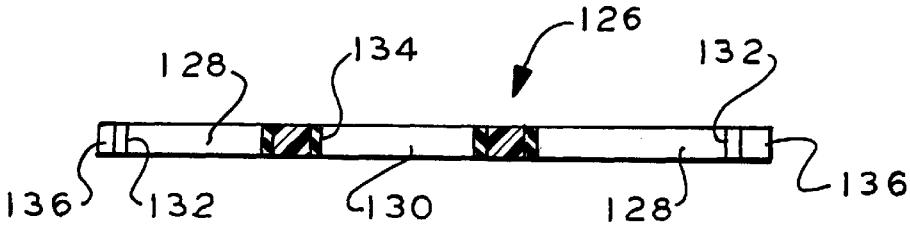
FIG. 9
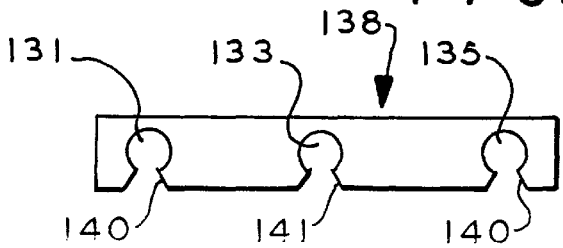

GOLF CLUB AND UMBRELLA HOLDING DEVICE

FIELD OF THE INVENTION

This invention relates to mounting devices for releasably securing a golf club to an umbrella to keep the club grip dry.

BACKGROUND OF THE INVENTION

U.S. Pat. No. 5,673,718 discloses a golf club hanger which suspends golf clubs beneath an umbrella from the umbrella struts. This is to keep the golf club grip dry during rain. An elongated body is suspended to and beneath the struts, the golf club being attached to the end of the body distal the struts. This is not believed satisfactory as the struts are relatively weak and typically fail during normal extended use of an umbrella Hanging a golf club from the umbrella struts may further weaken the struts and may cause premature failure thereof.

U.S. Pat. No. 4,852,896 discloses an umbrella for use with a golf cart golf equipment carrier. U.S. Pat. Nos. 3,014,595, 5,417,334, 5,820,479, 2,887,137, 5,669,514 and 5,474,191 all disclose various arrangements for holding a cluster of golf clubs and do not relate to the general problem of keeping the clubs dry as disclosed in U.S. Pat. Nos. 4,852, 896 and 5,673,718 ('718) discussed above.

SUMMARY OF THE INVENTION

The present inventors recognize a need for a umbrella golf club holder for portable use with an umbrella carried by the golfer to keep the clubs dry during use, is relatively durable and will not shorten the life of an umbrella as may occur with the hanger device disclosed in the '718 patent.

A golf club holder according to the present invention is for use with an umbrella having a shank, a handle at one shank end and an umbrella sheet member attached to the shank adjacent to the other shank end. The holder comprises a first body having a shank receiving first receptacle for attachment to the umbrella shank and a golf club securing device secured to the body including means for releasably receiving, securing and suspending a golf club shaft to the device to thereby releasably attach the golf club to the umbrella shank.

In one embodiment the device includes means for releasably receiving and attaching a plurality of club shafts thereto. Preferably the device is integral one piece with the body. In a further embodiment the club shaft has a longitudinal axis, the device comprising a second body having a second receptacle and a slot in the second body in communication with the second receptacle for receiving the golf club shaft transversely the shaft longitudinal axis through the slot into the second receptacle.

In a still further embodiment, the umbrella shank has a longitudinal axis, the first body having a slot in communication with the receptacle for receiving the umbrella shank transversely the shank longitudinal axis through the slot into the receptacle. In a still further embodiment, means are included for movably securing the device to the first body and preferably comprising a hinge.

The device in a further embodiment, has an operative first position and an idle folded second position, the device in a further embodiment further including a hook for releasably securing the device to the body in the first position. A plurality of the devices in a further embodiment are included secured to the first body.

In a still further embodiment, the device and body comprise a first section having the receptacle and including the means for releasably securing the club shaft to the device and a second elongated section for securing the umbrella shank to the body, the first and second sections cooperating to secure the umbrella shank thereto. The means for releasably securing may the shaft comprise a resilient clamping member for securing the club shaft thereto.

In a further embodiment, the club shaft and umbrella shank each has a longitudinal axis, the device means for releasable securing comprising a second body with a second receptacle for receiving the club shaft, the first and second receptacles each being coupled to a corresponding separate slot in the first body and in the second body for resiliently receiving the respective umbrella shank and golf club shaft transversely the longitudinal axes thereof through the slots into the receptacles.

Preferably friction means are in the first and second receptacles for frictionally engaging and clamping the respective umbrella shank and golf club shafts thereto against the force of gravity while the club and the shank are vertical.

In a further embodiment, resilient means are provided for resiliently slidably engaging the club shaft and umbrella shank for holding the shank and club to the body and device in a given axial shank position while the club and shank are vertical.

In a further embodiment, the umbrella sheet material has a folded collapsed state and an open deployed state, the umbrella including a plurality of struts for movably positioning the sheet material to the deployed and collapsed states, the body including means for movably securing the struts thereto distal the sheet material such that axial displacement of the body along the umbrella shank positions the sheet material in the deployed and collapsed states.

IN THE DRAWING

FIG. 1 is a perspective view of an umbrella with a golf club holding device according to an embodiment of the present invention secured to the umbrella;

FIG. 2 is a plan sectional view of the device of FIG. 1;

FIG. 3 is a side elevation view of the device of FIG. 1 shown in more detail;

FIG. 4 is a side elevation sectional view of the device of FIG. 2 taken along lines 4—4 without the umbrella shank and golf club shafts attached;

FIG. 5 is a side elevation view of a deployable golf club holder device according to a second embodiment of the present invention in the deployed position;

FIG. 6 is a view similar to that of FIG. 5 showing the deployable device during retraction to an idle position;

FIG. 7 is a fragmented side elevation view partially in section of a further embodiment of a golf club holding device according to the present invention;

FIG. 8 is a side elevation sectional view of a further embodiment of a golf club holding device according to the present invention;

FIGS. 9 and 10 are plan views of further embodiments of the device of the present invention;

DETAILED DESCRIPTION OF THE PREFERRED EMBODIMENTS

Figure 12:
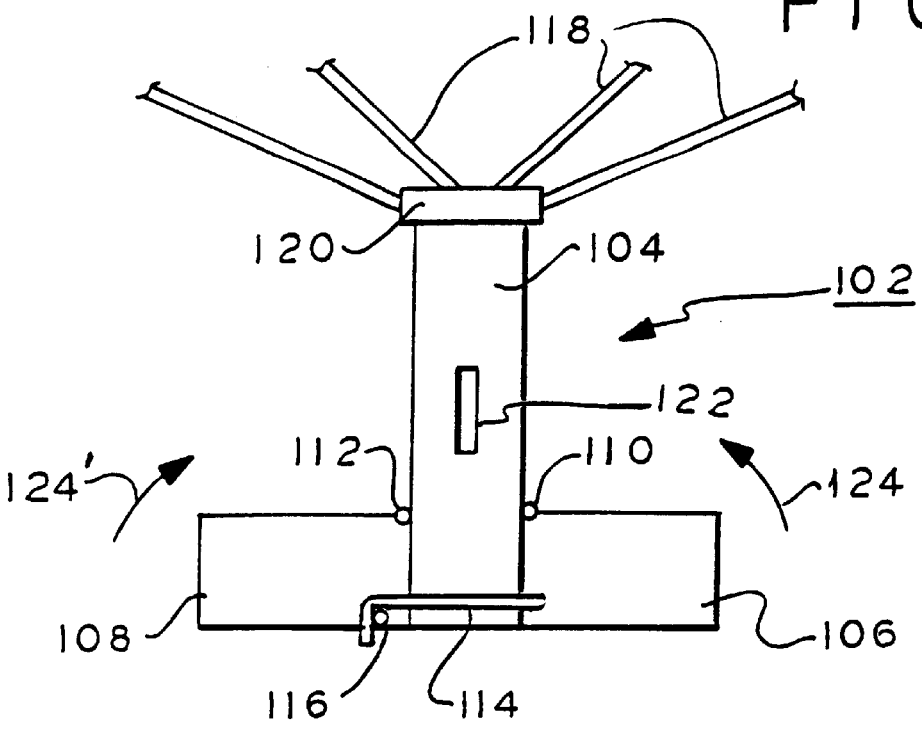
FIG. 12 is a side elevation view of a further embodiment of the device of the present invention.

In FIG. 1, umbrella 2 comprises a shank 4, struts 6 and 8, an umbrella sheet material 10 and a handle 12. The umbrella 2 is conventional and commercially available in numerous configurations. The struts 6 support the flexible sheet material which may be a fabric, plastic sheeting and the like as known. The struts 8 are pivotally connected to struts 6 and to central sleeve 14 which slides along the shank. The sleeve 14 includes a notch (not shown) which mates with two spaced spring loaded catches (not shown) mounted in the shank 4 for securing the umbrella in the open deployed state shown and in the closed folded state (not shown) in a known manner. One catch is at the position of the sleeve 14 adjacent the sheet material and the other catch is adjacent to the handle 12. Release of a catch permits the sleeve to be slid along the shank 4 between the two positions, opening and closing the umbrella.

Club holder 16 of the present invention releasably secures one or two golf clubs 18, 18' underneath the sheet material 10 to protect the grips 20 of the clubs from rain to keep the grips 20 dry. In FIGS. 2–4, club holder 16 comprises molded integral one piece thermoplastic T-shaped shaped element. The holder 16 has a club clamping head 22 and a stem 42 depending from the head 22. The head 22 is generally a rectangular block having three spaced circular cylindrical bores 24, 26 and 28. The bores 24, 26 and 28 are each preferably lined with liner 30 or 32 comprising a relatively high friction material such as a sheet of rubber, sheet elastomeric material, ribbed or dimpled sheet plastic or elastomeric material and so on. A liner 30 is in each bore 24 and 28 and liner 32 is in bore 26.

A slot 34 passes through the lateral side wall 31 of the head 22 into communication with bore 24, dividing the side wall 31 into two sections forming a resilient shaft retaining clip. A slot 36 passes through the front wall 37 of head 22 into communication with bore 26 and a slot 38 passes through the side wall 40 of head 22 into communication with bore 28. Each of these slots divides their corresponding walls into two sections. The slots form the head 22 at the bores into three resilient U-shaped clamps for respectively snap clamping the golf clubs 18, 18' shaft and the umbrella shank 4 to the head 22.

The liners 30 frictionally engage the club shafts of different clubs to hold the shafts thereto when the shafts are suspended therefrom vertically as in FIG. 1. The liner 32 similarly engages the umbrella shank 4 to hold the shank thereto in the vertical orientation. This holds the holder 16 to the shank in a given longitudinal axial position along the shank while the shank is vertical. The weight of the clubs and holder do not cause the holder to slide down the vertically oriented shank. The bores and liners 30 and 32 together form a receptacle for the club shafts and umbrella shank that is slightly smaller in internal diameter than the external shaft or shank diameters to provide slight interference fit therebetween. The receptacles and slots form spring action clips for holding the shafts and shank in place.

The holder 16 includes an elongated square (or rectangular or other shape) in transverse section stem 42 that depends from the head 22 and is preferably integral one piece molded with the head 22. The stem 42 and head cooperate to provides an elongated bore and liner for gripping the shank 4 of the umbrella to retain the holder 16 in place on the shank 4. The longer stem 42 provides additional resistance to sliding action of the holder 16 with the clubs attached. The stem 42 merely forms an extension of the bore 26 and liner 32 in the head 22.

The orientation of the stem 42 and head 22 on the shank 4 may be reversed so that the stem 42 is vertically above the head 22 when attached to the shank. The relative size of the bores, head, slots and stem is exaggerated in the drawing and is not to scale. The slots may, in practice, be about ⅜ inch wide, the head 22, FIG. 2, may be about 13/16 inches wide, about 3¾ inches long and about 13/16 inches thick when formed of molded thermoplastic material. The stem 42 and head together may be about 2 15/16 inches long and the stem may be about 13/16 inches square in transverse section. The thicknesses of the walls 46, 46' on opposite sides of the bores 24 and 28 are substantially the same. The rubber liners 30 and 32 have about a ½ inch diameter and are about 1/16 inches thick.

In operation, the holder 16 body containing the bore 26 and mating liner 32 are snap fit over the umbrella shank 4 by laterally sliding the shank through the slot 36 in the head 22 and in the stem 42. The body forming the head 22 and stem 42 is somewhat resilient and is hinged by the thin weakened section 44, FIG. 2. The sides of the slot 36 in the front wall 37 thus resiliently spread apart to allow the umbrella shank to be passed transversely through the slot into the bore 26. These slot side walls then snap return to their normal position clamping the shank to the holder 16 resiliently and frictionally locking the holder axially in place.

Similarly, the side section walls of side wall 31 in the head 22 forming the slot 34 spread apart to permit the golf club shaft 18 to be slid laterally through the slot into the bore 24. In this case the head 22 thin weakened sections 46, 46' at the bore 24 form hinges This action resiliently spreads the side wall 31 sections apart at the slot 34 and resiliently clamp the inserted golf club shaft forming a shaft clip. The clamp formed by bore 28 and slot 38 function similarly with the insertion of the mating golf club 18' shaft. It should be understood that the drawing is not to scale and that other dimensions can be easily determined empirically by one of ordinary skill in this art. The relative thicknesses and sizes of the bores, slots, shafts and shank in the drawing being not to scale are shown merely for purposes of illustration.

The extension formed by stem 42 is optional depending upon the material used, its resiliency and gripping friction magnitude. The resiliency of the head 22 and the stem 42 at the slot 36 is according to a given material employed and the dimensions used for the slot and hinge thicknesses for each clamp configuration formed by the bores. The liners for gripping the engaged shank and shafts are also optional in accordance with a given implementation. That is by forming the head and body of high friction material or with a surface roughness to enhance sliding friction with the engaged shafts and shank, a liner may not be necessary.

While the head 22 and stem 42 are referred to as separate elements, they are integral one piece in this embodiment. Also the term body in the claims refers to that portion of the head 22 and stem 42 for gripping the umbrella shank whereas the claimed device refers to the portions of the head that grip the golf club shafts. While these elements are shown as one piece in the FIGS. 2–4 embodiment, they may be separate pieces as described below with other embodiments. Thus the term "body" in the claims refers to that portion of the holder used to clamp the umbrella shank whereas the claimed device is that portion used to clamp the club shafts.

In FIGS. 5 and 6, a second embodiment of a golf club holder 50 of the present invention comprises an elongated stem 52. The stem 52 preferably is square in section but may be round or other shapes and is preferably formed of molded thermoplastic or other material. The stem 52 has a bore 54 and a slot 56. The bore 54 and slot 56 receive the umbrella shank in a manner similar to that described above in connection with the embodiment of FIG. 2.

Golf club clip holding devices are formed by shaft receiving devices 58 and 60. The devices 58 and 60 are preferably identical and are secured to opposite sides of the stem 52 in mirror image relation. They maybe also be in other orientations relative to each other as desired in a given implementation. Devices 58 and 60 together with the stem 52 form a club securing holder for securing the shafts of a corresponding golf club thereto. Device 58 has shaft receiving bore 62 and device 60 has shaft receiving bore 64. The bores 62 and 64 may be identical to the bores 24 and 28 in the embodiment of FIG. 2 and may also include liners (not shown). Slots (not shown) also couple the bores 62 and 64 externally the devices similar to the slots of the FIG. 2 embodiment to form receptacle clips for the club shafts.

Device 58 is secured to stem 52 by hinge 66 and device 60 is secured to stem 52 by hinge 68 for rotation in respective directions 66' and 68'. A hook 70 is pivotally secured to device 58 at pivot 72. The hook 70 has a bent end 71 that engages pin 72 (or eyelet) in device 60. The hook 70 locks the devices in a deployed position as shown. In this position, the devices abut the body 52 at the hook region and are locked in the orientation for use to receive the club shafts as in FIG. 1. The hook is rotated to release the devices so that they may rotate to the folded idle position in the directions of arrows 74, FIG. 6.

When the umbrella is folded to its normal collapsed state as typical for umbrellas when not in use, the devices are folded down from the orientation of FIG. 5 (shown in the intermediate stage in FIG. 6) to that as shown in phantom. This permits the umbrella sheet material to collapse to the folded state with minimum interference from the devices 58 and 60 which interference might otherwise occur when deployed.

In a further embodiment, the devices 58 and 60 may be reversely oriented 180° from the orientation shown along the stem 52 to a position similar to the orientation shown in FIG. 12 to be discussed below. In this reverse orientation the use of a hook is optional as gravity holds the devices in the deployed orientation wherein the hinges are located at the top of the devices rather than at the bottom. In FIG. 6 gravity holds the devices 58 and 60 in the folded idle position.

In FIG. 7, golf club holder 76 comprises an elongated stem 78. Stem 78 is tubular and may be molded thermoplastic material or other material, e.g., a sheet metal tube. The stem 78 has a bore 80 for receiving the umbrella shank 4. The stem slides along the shank 4 in directions 82. A plurality of struts 84 are pivotally connected to the stem 76 at pivots 86 as in conventional umbrellas. A collar (not shown) may be secured to the stem (which may be made of thinner material than that shown) for receiving the struts 84. The stem includes a metal tubular member 88 with a slot 90 for engaging a conventional catch (not shown) on the shank 4. The catch holds the stem in the deployed position with the sheet material deployed as shown in FIG. 1. A slot or recess 92 in the stem 76 engages a second catch (not shown) secured to the shank 4 for holding the umbrella folded in the closed state (not shown).

A pair of golf club holding devices 94 and 96 are hinged to the stem 76 similarly as the devices 58 and 60 of the embodiment of FIGS. 5 and 6. These devices are held in the deployed position the same as illustrated in the embodiment of FIG. 5 by a hook 98 and pin 100. The devices fold to permit the umbrella to close to the collapsed state (not shown).

The stem 76 is slid up and down the shank 4 as in conventional umbrellas to open and close the umbrella. This positions the devices in the closed state near the shank 4 handle such as handle 12, FIG. 1. The stem 76 is then slid upwardly to open the umbrella as in conventional umbrellas. When open, the devices are then rotated to the deployed position similar to that of the embodiment of FIG. 5 and locked in place by hook 98. The clubs are then attached as shown in the FIG. 1 embodiment. More or fewer devices 94 and 96 may be used according to a given implementation and at any angular orientation about the shank 4.

In FIG. 12, holder 102 comprises stem 104 and club shaft holding devices 106 and 108. Device 106 is attached to stem 104 by hinge 110 and device 108 is attached to stem 104 by hinge 112. Hook 114 engages pin 116 on device 108. Hinges 110 and 112 are at the top edges of the devices 106 and 108 when the stem 104 is vertical as attached to the umbrella shank. Struts 118 are pivotally secured to collar 120 attached to the stem 104. The stem 104 has a slot 122 for engaging the catches (not shown) on the umbrella shank. Preferably the stem 104 is molded thermoplastic material or sheet metal. The stem 104 has a length sufficient to accommodate the devices 106 and 108 when folded in directions 124, 124' when the umbrella is collapsed In FIG. 8, holder 126 comprises a sheet of material such as molded thermoplastic. The holder 126 has bores 128 and 130. Bores 128 and 130 are lined with rubber liners 132, 134. Slots are formed in the holder such as slots 136, 136 and a further slot not shown in communication with bore 130. The holder 126 has no stem as in the embodiment of FIG. 3. The bores and liner are configured to hold the clubs thereto with a relatively thin thickness as compared to the above embodiments.

In FIG. 9, holder 138 is formed of molded material having three receptacles 131, 133, and 135. Receptacle 133 receives the umbrella shank and the other receptacles receive the golf club shafts. The ingress region of each receptacle is formed with a slot with a tapered lead in portion 140, 141. The holder 138 is readily clipped onto an umbrella shank as are the golf club shanks clipped onto the holder. The important aspect is that the holders all are retained on the umbrella shank by friction for those holders that are removably attached to the shank. Those that are permanently attached to the shank need not have a liner or high friction engagement with the shank as they are retained in the upper shank position by the catch on the shank, FIGS. 7 and 12.

Figure 10:
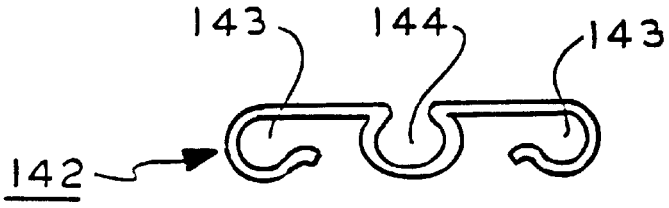
Figure 11:
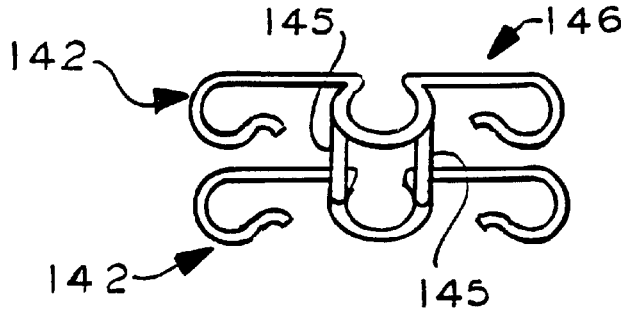
FIG. 11 is an isometric view of a further embodiment of the device of the present invention.

In FIG. 10, a further embodiment of a holder 142 comprises a bent formed wire that is preferably coated with a thermoplastic or rubber layer to provide high gripping friction to the shank or clubs. The holder 142 has U-shaped clips 143 and 144 for respectively gripping club shafts and an umbrella shank. The clip 144 is dimensioned to tightly clamp the shank thereto to preclude sliding vertically when the umbrella is in use while the clubs are suspended from the holder. In FIG. 11, a holder 146 includes a pair of holders 142 attached by members 145. The holders 142 are aligned so as to cooperatively grip an umbrella shank and the club shafts. While two holders are shown more may be used if necessary. A liner may be attached to the clips to further enhancing the gripping action. Such a liner may be a rubber or elastomeric split tubular element with a U-shaped transverse section, for example.

It will occur to one of ordinary skill that various modifications may be made to the disclosed embodiments, which are given by way of example and illustration and not limitation. It is intended that the scope of the invention is as defined by the appended claims.

What is claimed is:

1. A golf club holder for an umbrella having a shank, a handle at one shank end and an umbrella sheet member attached to the shank adjacent to the other shank end, the holder comprising:

a first body having a shank receiving first receptacle for attachment to the umbrella shank; and at least one golf club securing device secured to the first body including means for releasably receiving, securing and suspending a golf club shaft to the device to thereby releasably attach the golf club to the umbrella shank;

the receptacle defining a longitudinal axis corresponding to the longitudinal axis of the received umbrella shank, the body having a first length in the longitudinal direction forming a stem for creating a friction load on the received umbrella shank sufficient to hold the body in fixed position along the shank, the device having an opening for receiving the golf club shaft in a direction parallel to the longitudinal direction, the device having a second length in the longitudinal direction different than the first length whereby the body friction load is sufficient to hold the received umbrella shank in said fixed position and the device friction load is sufficient to hold the shaft in fixed position thereto.

2. The holder of claim 1 including means for movably securing the device to the first body.

3. The holder of claim 2 wherein the means for movably securing comprises a hinge.

4. The holder of claim 3 wherein the device has an operative first position and an idle folded second position, further including a hook for releasably securing the device to the body in the first position.

5. The holder of claim 1 wherein the means for releasable securing comprising a second body with a second receptacle for receiving the club shaft, the first and second receptacles each being coupled to a corresponding separate slot in the first body and in the second body for resiliently receiving the respective umbrella shank and golf club shaft transversely the longitudinal axes thereof through the slots into said receptacles.

6. The holder of claim 5 including friction means in the first and second receptacles for frictionally engaging and clamping the respective umbrella shank and golf club shafts thereto against the force of gravity while the held club and shank are vertical and the shaft is suspended from the holder.

7. The holder of claim 1 wherein the first length is greater than that of the second length, the body depending from the device.

8. The holder of claim 1 wherein the club shaft has a longitudinal axis, the device comprising a second body having a second receptacle and a slot in the second body in communication with the second receptacle for receiving the golf club shaft transversely the shaft longitudinal axis through the slot into the second receptacle and including a plurality of said devices, the first body being between the devices.

9. The holder of claim 1 wherein the first body comprises an elongated stem member and the device comprises at least one relatively foreshortened second member secured to and relative to the first body, the first body and device each having an opening for frictionally receiving and holding the respective shank and shafts in parallel fixed position thereto.

10. The holder of claim 1 wherein said at least one golf club securing device includes a plurality of devices.

11. The holder of claim 1 wherein the means for releasably securing comprises a resilient clamping member for securing the club shaft thereto.

12. The holder of claim 1 wherein the means for releasably securing includes resilient means for resiliently slidably engaging the club shaft, the body further including resilient means for resiliently releasable securing the umbrella shank to the body.

13. The holder of claim 1 wherein the umbrella sheet material has a folded collapsed state and an open deployed state, the umbrella including a plurality of struts for movably positioning the sheet material to the deployed and collapsed states, the body including means for movably securing the struts thereto distal the sheet material such that axial displacement of the body along the umbrella shank positions the sheet material in said deployed and collapsed states.

* * * * *